US006807752B2

(12) United States Patent
Nakano et al.

(10) Patent No.: US 6,807,752 B2
(45) Date of Patent: Oct. 26, 2004

(54) SOLE DESIGN AND STRUCTURE FOR ATHLETIC SHOE

(75) Inventors: Isao Nakano, Osaka (JP); Takaya Kimura, Osaka (JP); Seiichi Goto, Osaka (JP); Akihiro Miyauchi, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/389,319

(22) Filed: Mar. 14, 2003

(65) Prior Publication Data

US 2003/0177666 A1 Sep. 25, 2003

Related U.S. Application Data

(62) Division of application No. 09/832,056, filed on Apr. 10, 2001, now Pat. No. 6,557,270.

(30) Foreign Application Priority Data

May 9, 2000 (JP) ..... 2000-136365

(51) Int. Cl.[7] ..... A43B 13/12; A43B 5/00

(52) U.S. Cl. ..... 36/25 R; 36/30 R; 36/28; 36/67 R

(58) Field of Search ..... 36/25 R, 30 R, 36/28, 67 R, 59 C, 97, 134, 114

(56) References Cited

U.S. PATENT DOCUMENTS

| | | | | |
|---|---|---|---|---|
| 1,607,375 | A | | 11/1926 | Whipple |
| 4,130,947 | A | | 12/1978 | Denu |
| 4,151,661 | A | | 5/1979 | Namba et al. |
| 4,561,195 | A | | 12/1985 | Onoda et al. |
| 4,798,010 | A | | 1/1989 | Sugiyama |
| 5,131,173 | A | * | 7/1992 | Anderie ..... 36/25 R |
| 5,400,526 | A | | 3/1995 | Sessa |
| 5,720,118 | A | | 2/1998 | Mayer et al. |
| 5,832,636 | A | | 11/1998 | Lyden et al. |
| 6,145,221 | A | | 11/2000 | Hockerson |
| 6,295,741 | B1 | * | 10/2001 | Kita ..... 36/30 R |
| 6,389,713 | B1 | * | 5/2002 | Kita ..... 36/30 R |
| 6,557,270 | B2 | * | 5/2003 | Nakano et al. ..... 36/25 R |
| 6,625,905 | B2 | * | 9/2003 | Kita ..... 36/30 R |
| 6,647,645 | B2 | * | 11/2003 | Kita ..... 36/28 |
| 2003/0192199 | A1 | * | 10/2003 | Nakano et al. ..... 36/25 R |

FOREIGN PATENT DOCUMENTS

| | | |
|---|---|---|
| EP | 0373336 | 6/1990 |
| EP | 0857434 | 8/1998 |
| EP | 0878142 | 11/1998 |
| EP | 0963711 | 12/1999 |
| JP | 11-203 | 1/1999 |
| JP | 11-332606 | * 12/1999 |
| JP | 11-346803 | * 12/1999 |

* cited by examiner

*Primary Examiner*—M. D. Patterson
(74) *Attorney, Agent, or Firm*—W. F. Fasse; W. G. Fasse

(57) ABSTRACT

An athletic shoe sole structure includes a midsole body that extends from a heel region to a forefoot region of a shoe, and an outsole body that is disposed under the midsole body, extends from the heel region to the forefoot region of the shoe, and is formed of a harder material than the midsole body. A heel portion of the outsole body includes a corrugation. The sole structure further includes a lower midsole disposed under the heel portion of the outsole body, an outsole heel portion attached at a lower surface of the lower midsole, and cleats provided at a lower surface of the outsole body. The sole structure having only two layers with the outsole and the midsole decreases the weight of the shoe, simplifies a manufacturing process, and reduces a manufacturing cost.

5 Claims, 7 Drawing Sheets

SOLE DESIGN AND STRUCTURE FOR ATHLETIC SHOE

CROSS-REFERENCE TO RELATED APPLICATIONS

This application is a Divisional of U.S. application No. 09/832,056, filed Apr. 10, 2001, now U.S. Pat. No. 6,557, 270, issued May 6, 2003.

BACKGROUND OF THE INVENTION

This invention relates to a sole structure for an athletic shoe, especially for a spiked shoe such as a soccer shoe, a baseball shoe, a golf shoe, or the like.

A prior art sole structure of an athletic shoe for use in various sports is shown in Japanese patent application laying-open publication No. 11-203. This sole structure includes an upper midsole and a lower midsole both of which are generally formed of soft elastic materials, a corrugated sheet interposed between the upper and lower midsoles, and an outsole disposed under the lower surface of the lower midsole and directly contacting the ground.

In such a shoe, due to the corrugated sheet interposed in the heel portion of the midsole, a resistant force tends to occur that restrains the heel portion of the midsole from deforming transversely at the time of contacting the ground, which prevents the heel region of the shoe from slanting sideways and thus, running stability is secured.

The prior art sole structure, however, is comprised of four layers including an upper midsole, a lower midsole, a corrugated sheet, and an outsole, thereby making the weight of the whole sole structure heavier and making the assembly process rather complicated, and an extra cost of a mold becomes necessary.

An object of the present invention is to provide a sole structure for an athletic shoe that secures running stability, decreases weight, simplifies a manufacturing process, and reduces cost. Another object of the present invention is to control flexibility or bendability of an outsole or an outsole body of a shoe structure. A still another object of the current invention is to regulate an upper force applied to an outsole or an outsole body from the ground.

SUMMARY OF THE INVENTION

In one embodiment, the sole structure includes a midsole and an outsole located under the midsole and formed of a harder material than the midsole. The midsole is disposed at least at a heel region of a shoe and the midsole heel portion is formed with corrugation at a lower surface thereof at least either on a medial or on a lateral side. The outsole includes an outsole heel portion having corrugation corresponding to the corrugation of the midsole heel portion and an outsole forefoot portion extending from or formed integrally with the outsole heel portion.

Owing to the corrugation or wavy configuration formed at each contact surface between the outsole and the midsole, a resistant force occurs that restrains the midsole heel portion from deforming laterally at the time of contacting the ground, thereby preventing the heel region of the shoe from slanting sideways and securing running stability. Moreover, a two-layer-sole structure with the midsole and the outsole reduces the number of components of the sole structure, decreases the weight of the whole sole structure, simplifies a manufacturing process, and reduces a cost of molds. Furthermore, since the sole structure can be made thinner than a prior art structure, bendability or flexibility of the sole is improved.

The outsole forefoot and heel portions may be formed of the same material or a different material. The midsole may be extended from the heel region to the forefoot region of the shoe. In this case, cushioning properties are ensured along the whole length of the shoe. The wavy configuration of the outsole heel portion may be formed consecutively and laterally between a medial side and a lateral side of the outsole heel portion. In this case, lateral slanting of the heel region of the shoe is more securely prevented. The outsole forefoot portion may also be formed with corrugation. Thus, lateral slanting of the forefoot region of the shoe as well can be prevented.

In a second embodiment, a plurality of plastic or metallic cleats or spikes are provided under the outsole. The sole structure of this embodiment may be applied to a spiked shoe, such as a soccer shoe, a baseball shoe, a golf shoe, a track shoe, or the like. Preferably, the cleats are adapted to control bendability or flexibility of the outsole and to control an upper force applied to the outsole from the ground. The cleats may be located at a crest or a trough of the corrugation of the outsole. Here, the term "crest" and "trough" are interpreted in FIG. 7, which is a side enlarged view of the sole structure. As shown in FIG. 7, a convex portion on the uppers side away from the ground is a crest whereas a convex portion on the ground side is a trough.

In this case, flexibility of the outsole is prevented from being hindered. Specifically, when the cleats are provided at a trough of the corrugation of the outsole, the upper force applied to the cleats from the ground is transmitted to the adjacent crests disposed on both sides of the trough, and thus, the upper force is dispersed and relieved.

The cleats may be disposed between a crest and the adjacent crest or a trough and the adjacent trough of the corrugation of the outsole. In this case, the upper force applied to the cleats from the ground is effectively relieved by the corrugation of the outsole and flexibility of the outsole is restrained. For example, when the cleats are located between a trough and the adjacent trough of the corrugation of the outsole, the upper force from the ground is dispersed and absorbed by the both troughs.

The heel portion of the midsole may have a corrugated sheet or wavy plate therein. In this case, lateral leaning of the heel region of the shoe is further securely prevented.

In a third embodiment, the sole structure includes a midsole body, an outsole body disposed under the midsole body and formed of a harder material than the midsole body, a lower midsole disposed under the heel portion of the outsole body, and an outsole heel portion attached under the lower midsole. The midsole body and the outsole body extend from the heel region to the forefoot region of the shoe. The outsole body has corrugation at least at the heel portion thereof.

In this embodiment, the corrugation formed at the heel portion causes a resistant force that prevents the heel portion of the midsole body from deforming laterally at the time of contacting the ground, thereby preventing the heel region of the shoe from slanting sideways and thus, securing a running stability. Moreover, in this case, the forefoot region of the shoe has a double-layer-sole structure with the midsole body and the outsole body, which reduces the number of shoe components, decreases the weight of the shoe, simplifies a manufacturing process, and reduces a manufacturing cost. Furthermore, since the sole structure can be made thinner as compared with the prior art structure, bendability or flexibility of the forefoot region of the shoe is advanced. The outsole body may have corrugation at a forefoot portion thereof. In this case, lateral leaning of the forefoot region of the shoe can also be prevented.

In a fourth embodiment, a plurality of cleats are provided under the outsole body. The sole structure of this embodiment may be applied to a spiked shoe, such as a soccer shoe, a baseball shoe, a golf shoe, a track shoe, or the like. The cleats are preferably adapted to control bendability or flexibility of the outsole body and to control an upper force applied to the outsole body from the ground. The cleats may be located at a crest or a trough of the corrugation of the outsole body. In this case, bendability or flexibility of the outsole body can be restrained from being hindered. Specifically, when the cleats are provided at a trough of the corrugation of the outsole body, the upper force applied to the cleats from the ground is dispersed and relieved by the adjacent crests. Alternatively, the cleats may be disposed between the adjacent crests or troughs of the corrugation of the outsole body. In this case, the upper force applied to the cleats from the ground is effectively relieved by the corrugation of the outsole body and the flexibility of the outsole is restrained.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
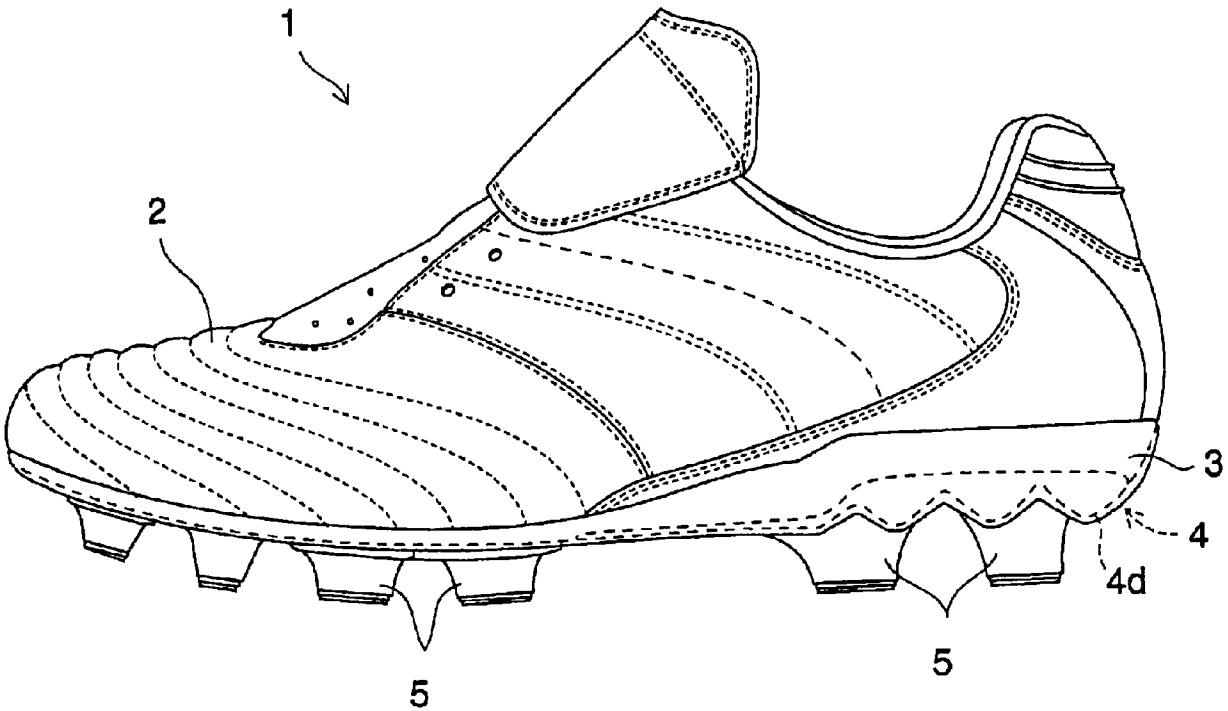
FIG. 1 is a side view of a soccer shoe employing a sole structure of one embodiment of the present invention.

Turning now to the drawings, FIG. 1 shows a soccer shoe of one embodiment of the present invention. As shown in FIG. 1, a soccer shoe 1 has a sole structure that is formed of an outsole 3 provided under an upper 2 and extending from a heel region to a forefoot region of the shoe 1 and directly contacting the ground, and a midsole 4 provided inside the outsole 3 and under the upper 2 and extending from the heel region to a midfoot region of the shoe 1. On the lower surface of the outsole 3 a plurality of cleats 5 are provided.

Figures 2A, 2B, 2C:
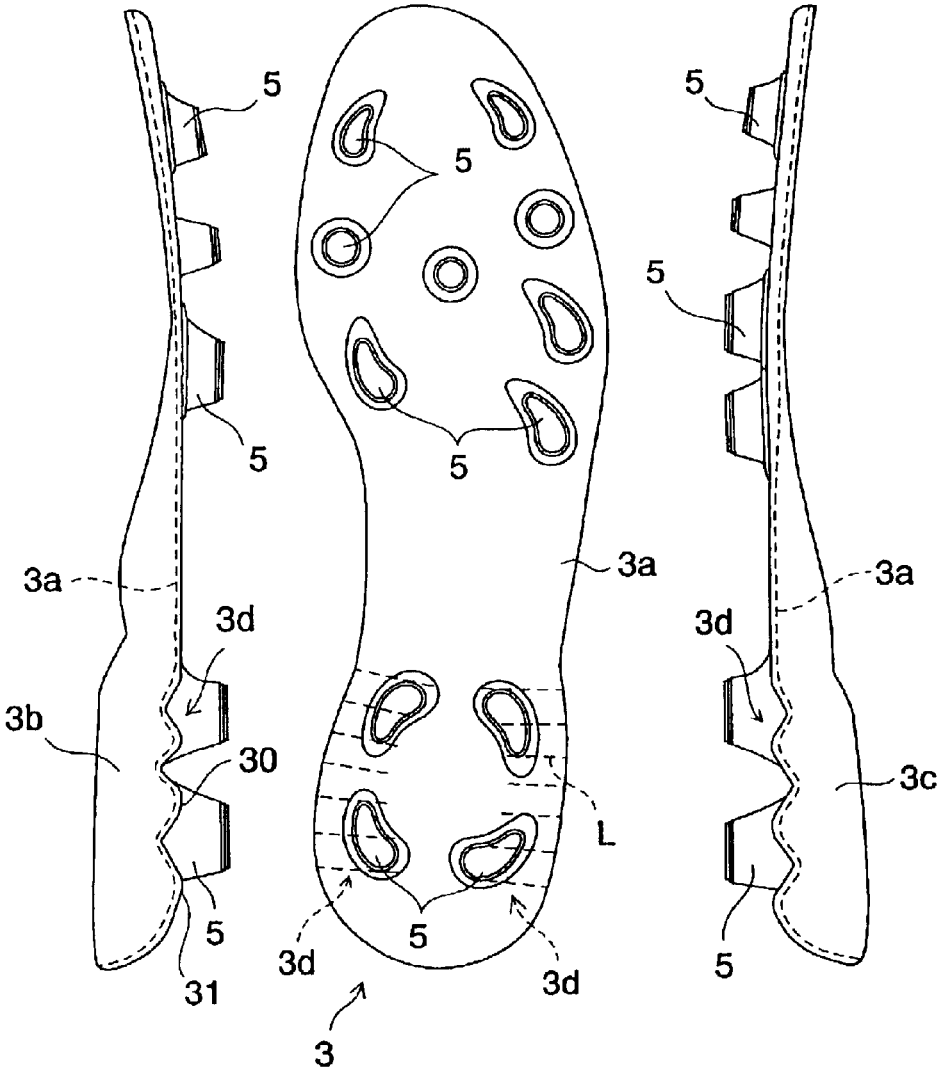
FIG. 2A is a bottom view of the sole structure of FIG. 1.
FIG. 2B is a medial side view of FIG. 2A.
FIG. 2C is a lateral side view of FIG. 2A.

As shown in FIGS. 2B and 2C, the outsole 3 includes upraised side portions 3*b* and 3*c* extending upwardly (or in the left and right directions of FIGS. 2B and 2C) from a base portion 3*a* on the medial and lateral sides. An outsole corrugated portion 3*d* having corrugation is formed at the base portion 3*a* on the medial and lateral sides of the heel portion of the outsole 3. A dashed line L of FIG. 2A indicates a ridge line and a trough line of the outsole corrugated portion 3*d*.

The midsole 4 is placed on the upper face of the base portion 3*a* of the outsole 3. A midsole corrugated portion 4*d* having corrugation, shown in FIG. 1, is formed on the lower face of the heel portion of the midsole 4. The shape of the midsole corrugated portion 4*d* corresponds to that of the outsole corrugated portion 3*d*.

The midsole 4 is generally formed of a soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber are used.

In this embodiment, since the outsole corrugated portion 3*d* is formed on the medial and lateral sides of the heel portion of the outsole 3 and the corresponding midsole corrugated portion 4*d* is formed on the lower face of the heel portion of the midsole 4, the corrugated contact faces between the outsole 3 and the midsole 4 generate a resistant force preventing the heel portion of the midsole 4 from deforming laterally at the time of contacting the ground. Thereby, sideways or lateral slanting of the heel region of the shoe can be prevented and running stability is secured.

Moreover, the sole structure of this embodiment is formed of double layers with the midsole 3 and the outsole 4, which decreases the number of components and the weight of the sole structure, simplifies a manufacturing process, and reduces a manufacturing cost. Furthermore, since the sole structure becomes thinner, its bendability or flexibility can be improved.

Figure 7:
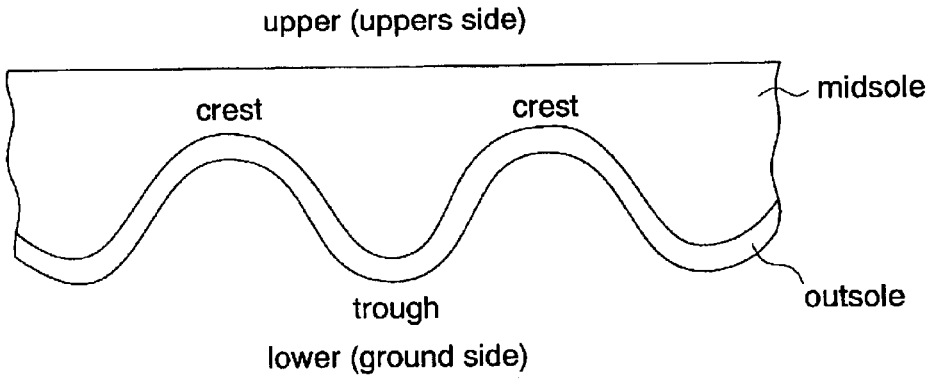
FIG. 7 is a side enlarged view illustrating corrugated portions of the outsole and the midsole.

Also, in this embodiment, as shown in FIGS. 2B and 2C, each of the cleats 5 at the heel region of the shoe 1 is disposed between a trough and the adjacent trough of the corrugated portion 3*d* of the outsole 3 (see FIG. 7). Thereby, an upper force applied to the outsole 3 from the ground is transmitted and dispersed to both the troughs 30 and 31 through the cleats 5. Thus, the upper force is absorbed and effectively relieved by the troughs 30, 31.

Figure 3:
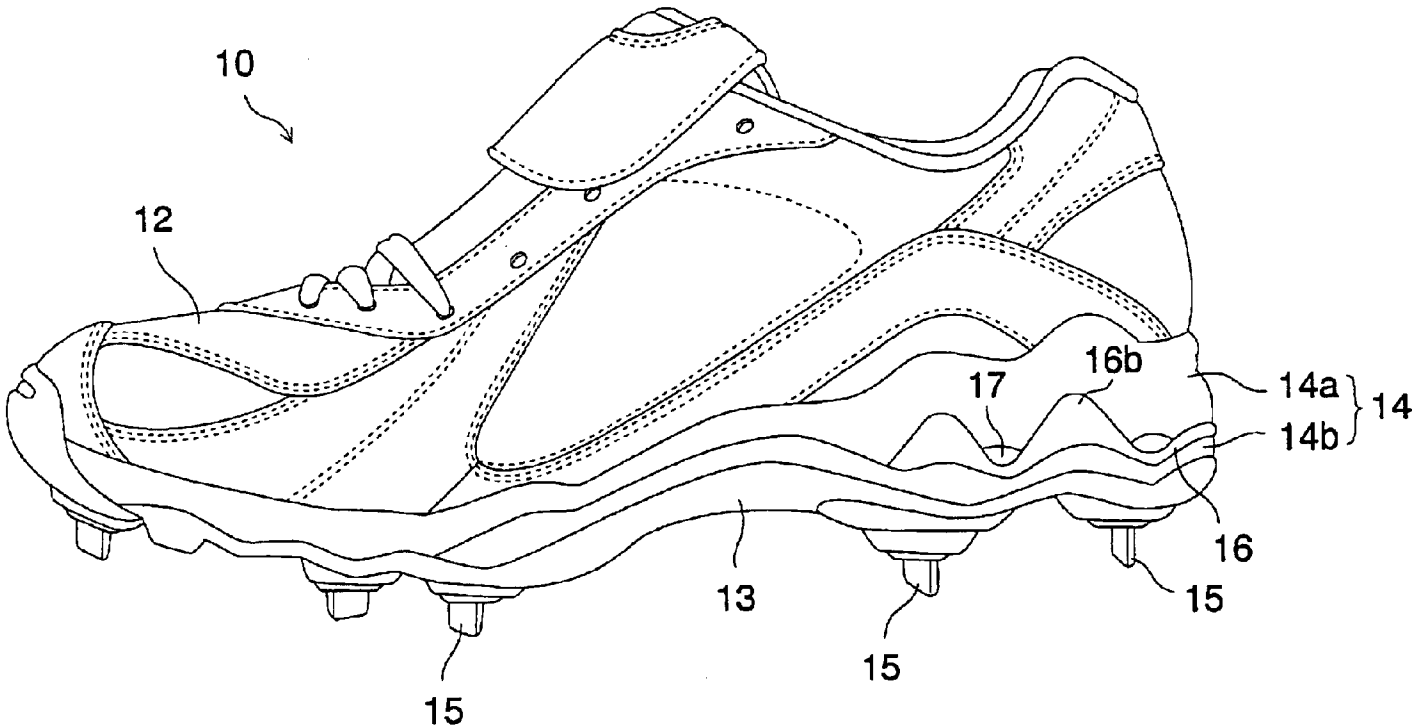
FIG. 3 is a side view of a baseball shoe employing a sole structure of a second embodiment of the present invention.

FIG. 3 depicts a spiked shoe for baseball of a second embodiment of the present invention. As shown in FIG. 3, a baseball shoe 10 has a sole structure that is formed of a midsole 14 provided under an upper 12 and extending from a heel region to a forefoot region of the shoe 10 and an outsole 13 provided under the midsole 14 and directly contacting the ground. On the lower surface of the outsole 13 a plurality of cleats or spikes 15 are provided.

The midsole 14 is formed of an upper midsole 14*a* attached to the bottom face of the upper 12 and a lower midsole 14*b* provided under the upper midsole 14*a*. A corrugated sheet or wavy plate 16 having corrugation on its medial and lateral sides is interposed between the upper midsole 14*a* and the lower midsole 14*b* at the heel region of the shoe 10. The corrugated sheet 16 has upraised side portions 16*a* and 16*b*, shown in FIGS. 4B and 4C, extending upwardly on the medial and lateral sides of the heel portion. The upper midsole 14*a* has a through hole 17 formed thereinto in the lateral direction. The midsole 14, as with the soccer shoe shown in FIG. 1, is formed of a soft elastic material having good cushioning properties, such as thermoplastic or thermosetting resin foam, rubber material foam or the like.

Figures 4A, 4B, 4C:
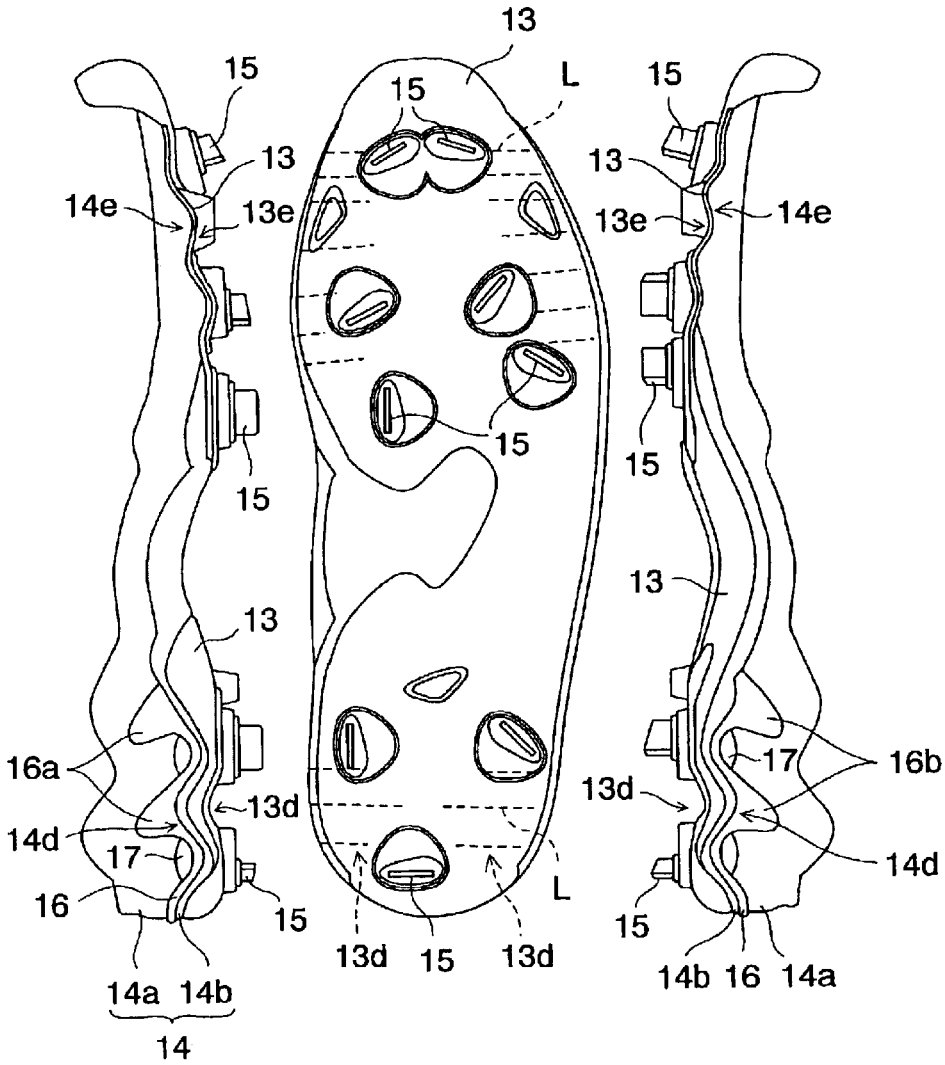
FIG. 4A is a bottom view of the sole structure of FIG. 3.
FIG. 4B is a medial side view of FIG. 4A.
FIG. 4C is a lateral side view of FIG. 4A.

As shown in FIGS. 4B and 4C, an outsole corrugated portion 13*d* is formed on the medial and lateral sides of the heel portion of the outsole 13. A dashed line L of FIG. 4A illustrates a ridge or crest line and a trough line of the outsole corrugated portion 13*d*. A lower midsole corrugated portion 14*d*, which corresponds to the outsole corrugated portion 13*d*, is formed on the medial and lateral sides of the heel portion of the lower midsole 14*b*. Similarly, an outsole corrugated portion 13*e* is formed on the medial and lateral sides of the forefoot portion of the outsole 13. An upper midsole corrugated portion 14*e*, which corresponds to the outsole corrugated portion 13*e*, is formed on the medial and lateral sides of the forefoot portion of the upper midsole 14*a*.

In this embodiment, since the outsole corrugated portion 13*d* is formed on the medial and lateral sides of the heel portion of the outsole 13 and the corresponding lower midsole corrugated portion 14*d* is formed on the lower face of the heel portion of the lower midsole 14*b*, the corrugated contact faces between the outsole 13 and the lower midsole 14*b* generate a resistant force preventing the heel portion of the midsole 14 from deforming laterally at the time of contacting the ground. Thereby, sideways or lateral slanting of the heel region of the shoe can be prevented and running stability is secured.

Moreover, in this embodiment, since the corrugated sheet 16 is interposed between the upper and lower midsoles 14*a* and 14*b*, transverse or lateral slanting of the heel region of the shoe can be more securely prevented owing to the corrugation of the corrugated sheet 16 that increases a compressive hardness of the midsole 14. Additionally, the corrugated sheet 16 may have a smaller shape than an outer circumferential shape of the heel portion of the outsole 13. In this case, the corrugated sheet placed inside the heel region does not appear on the medial and lateral sides of the heel region of the shoe.

Furthermore, in this embodiment, since the forefoot region of the shoe is formed of a sole structure with double layers of the outsole 13 and the upper midsole 14*a*, the number of shoe components is decreased, and thus, a lighter weight is achieved and a manufacturing process is simplified and a manufacturing cost is reduced. Also, as the sole structure is made thinner, bendability or flexibility of the forefoot region of the shoe is advanced.

Moreover, as the outsole corrugated portion 13*e* and the corresponding upper midsole corrugated portion 14*e* are formed at the forefoot region of the shoe 10, the corrugated contact faces between the outsole 13 and the upper midsole 14*a* generate a resistant force preventing the forefoot portion of the midsole 14 from deforming laterally or transversely at the time of contacting the ground. Thereby, sideways or lateral slanting of the forefoot region of the shoe can be prevented.

Also, in this embodiment, as shown in FIGS. 4B and 4C, each of the cleats 15 at the heel region of the shoe 10 is disposed at a trough of the outsole corrugated portion 13*d* (see FIG. 7). Thereby, an upper force applied to the outsole 13 from the ground is relieved through deformation of the trough. Similarly, as each of the cleats 15 provided specifically on the medial side of the forefoot region is disposed at a trough of the outsole corrugated portion 13*e*, not only bendability or flexibility of the forefoot portion is maintained but also the upper force applied to the forefoot region is effectively relieved.

Figure 5:
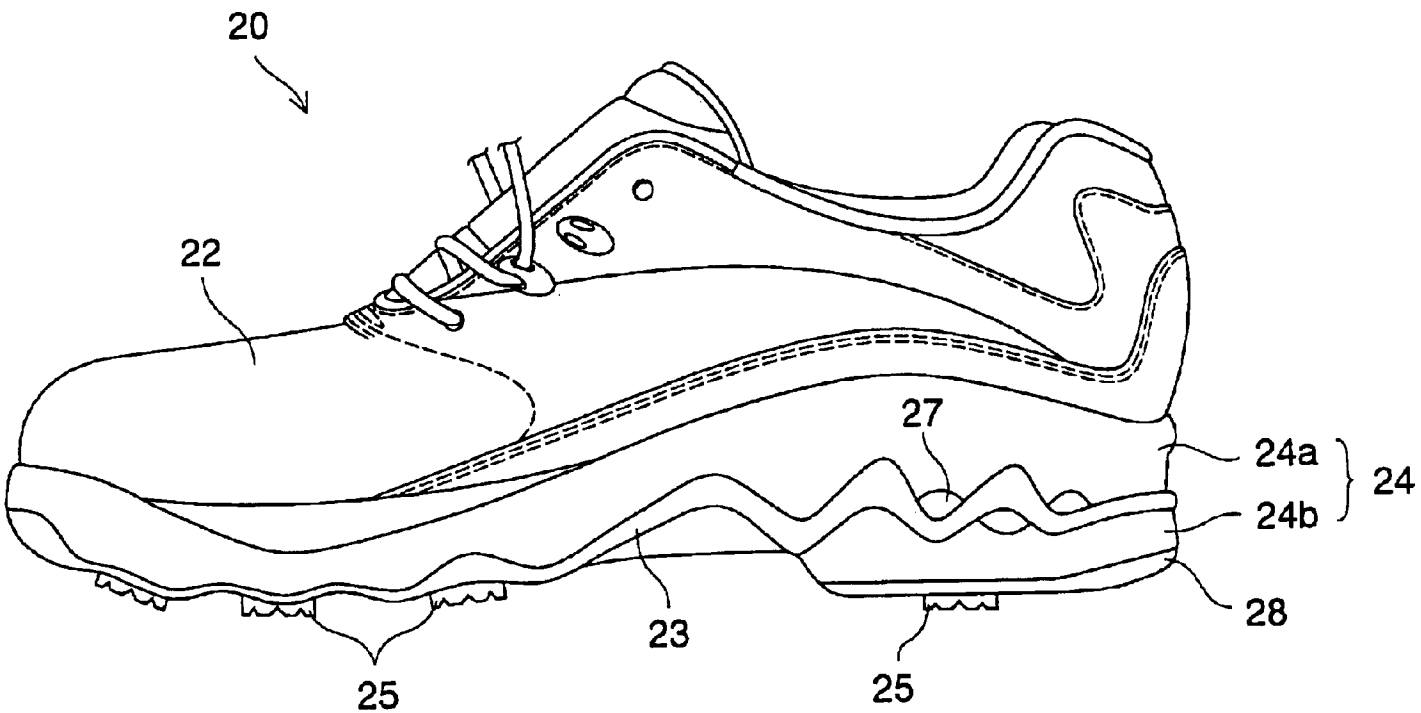
FIG. 5 is a side view of a golf shoe employing a sole structure of a third embodiment of the present invention.

FIG. 5 illustrates a golf shoe of a third embodiment of the present invention. As shown in FIG. 5, a golf shoe 20 has a sole structure that is formed of an upper midsole 24*a* provided under an upper 22 and extending from a heel region to a forefoot region of the shoe 20, an outsole body 23 provided under the upper midsole 24*a*, a lower midsole 24*b* provided under the heel portion of the outsole body 23, and an outsole heel portion 28 attached under the lower midsole 24*b*. The outsole body 23 has upraised side portions 23*a* and 23*b*, shown in FIGS. 6B and 6C, extending upwardly on the medial and lateral sides of the heel portion. On the lower surfaces of the outsole heel portion 28 and the forefoot and midfoot portions of the outsole body 23 are provided a plurality of cleats 25. A laterally extending through hole 27 is formed in the upper and lower midsoles 24*a* and 24*b*. The midsole 24, as with the soccer shoe in FIG. 1 and the baseball shoe in FIG. 3, is formed of a soft elastic material having good cushioning properties, such as thermoplastic or thermosetting resin foam, rubber material foam or the like.

Figures 6A, 6B, 6C:
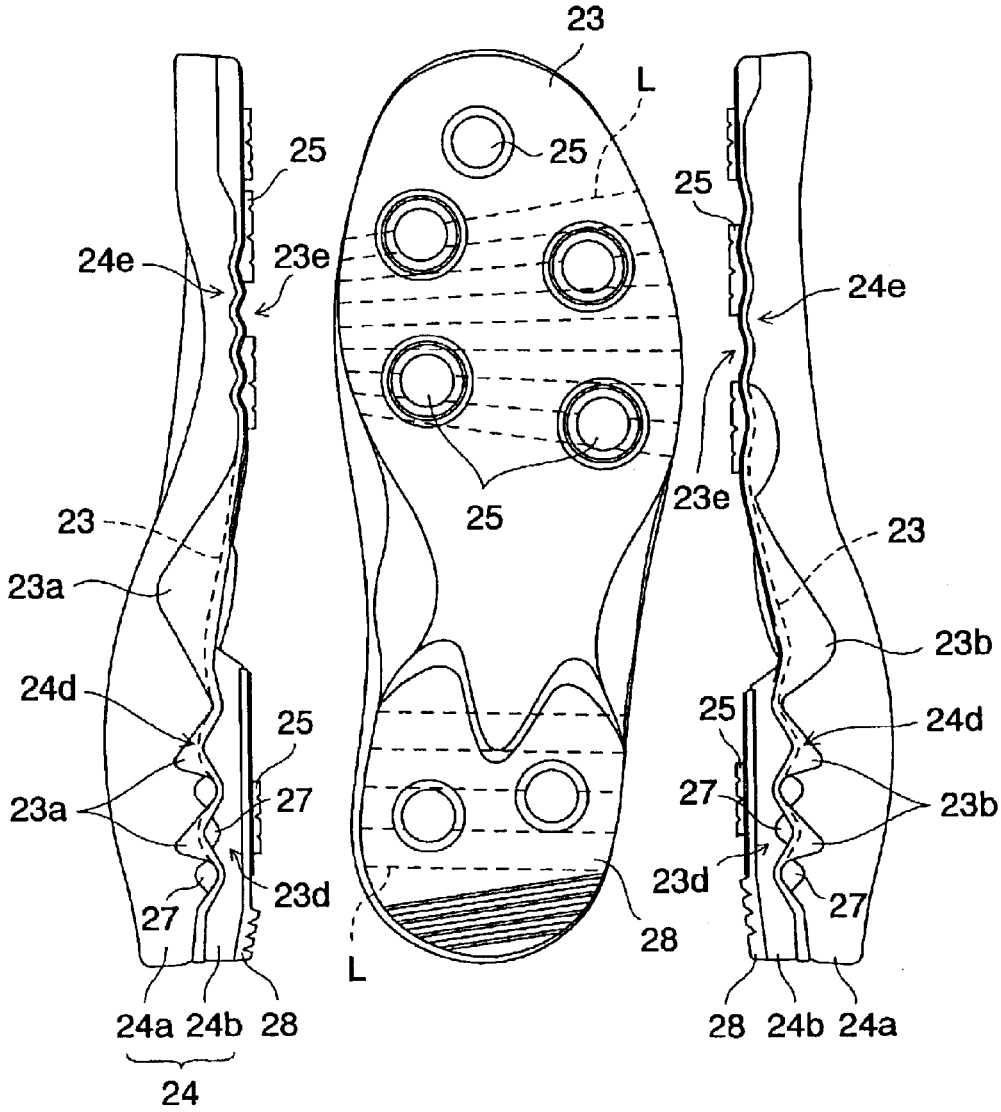
FIG. 6A is a bottom view of the sole structure of FIG. 5.
FIG. 6B is a medial side view of FIG. 6A.
FIG. 6C is a lateral side view of FIG. 6A.

As shown in FIGS. 6B and 6C, an outsole corrugated portion 23*d* is formed at the heel portion of the outsole body 23. A dashed line L of FIG. 6A indicates a ridge line and a trough line of the outsole corrugated portion 23*d*. A lower midsole corrugated portion 24*d*, which corresponds to the outsole corrugated portion 23*d*, is formed at the lower midsole 24*b*. Similarly, an outsole corrugated portion 23*e* is formed at the forefoot portion of the outsole body 23, and an upper midsole corrugated portion 24*e*, which corresponds to the outsole corrugated portion 23*e*, is formed at the forefoot portion of the upper midsole 24*a*. The wavelength of corrugation of the outsole corrugated portion 23*e* is relatively larger on the lateral side and relatively smaller on the medial side and trough line L are disposed radially.

In this embodiment, since the outsole corrugated portion 23*d* is formed at the heel portion of the outsole body 23, a resistant force occurs that restrains the heel portion of the midsole 24 from deforming laterally on contacting the ground. Thus, lateral slanting of the heel region of the shoe can be prevented and walking stability and swinging balance can be secured.

Moreover, in this embodiment, the sole structure of the forefoot region of the shoe is formed of double layers with the upper midsole 24*a* and the outsole body 23, which decreases the number of components and the weight of the structure, simplifies a manufacturing process, and reduces a manufacturing cost. Furthermore, since the sole structure becomes thinner, bendability or flexibility of the forefoot region of the shoe can be improved.

Furthermore, in this case, since the outsole corrugated portion 23*e* is formed at the forefoot portion of the outsole body 23, the forefoot region of the shoe is prevented from leaning in the lateral direction. Moreover, since each of the cleats 25 at the forefoot region of the shoe are disposed between a trough and the adjacent trough of the corrugation of the outsole corrugated portion 23*e*, the upper force applied to the outsole body 23 from the ground can be effectively absorbed and relieved through deformation of the trough portion of corrugation and bendability of the outsole body 23 can be maintained.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure of an athletic shoe comprising:

a midsole body extending from a heel region to a forefoot region of said shoe;

an outsole body disposed under said midsole body and extending from said heel region to said forefoot region of said shoe, said outsole body being formed of a material with a hardness greater than that of said midsole body, said outsole body having corrugations at least at a heel portion thereof in said heel region of said shoe;

a lower midsole disposed under said heel portion of said outsole body;

an outsole heel portion attached at a lower surface of said lower midsole; and a plurality of cleats provided on at least one of a crest line and a trough line of said corrugations on a bottom surface of said outsole body.

2. The sole structure of claim 1, wherein said outsole body has said corrugations formed also at a forefoot portion thereof in said forefoot region of said shoe, where said cleats are provided.

3. The sole structure of claim 2, wherein said bottom surface of said outsole body at said forefoot portion thereof is downwardly exposed ground contact surface adapted to contact the ground.

4. The sole structure of claim 1, wherein said cleats are positioned relative to said at least one of a crest line and a trough line of said corrugations so as to limit a bendability of said outsole body.

5. The sole structure of claim 1, wherein said cleats are positioned on said bottom surface to receive an upward force that is generated by contacting the ground and to transmit and apply the upward force through said cleats to said outsole body.

* * * * *